US005662456A

United States Patent [19]

Engländer

[11] Patent Number: 5,662,456

[45] Date of Patent: Sep. 2, 1997

[54] FRICTION VACUUM PUMP WITH BEARING SUPPORT

[75] Inventor: Heinrich Engländer, Linnich, Germany

[73] Assignee: Leybold Aktiengesellschaft

[21] Appl. No.: 545,645

[22] PCT Filed: Mar. 14, 1994

[86] PCT No.: PCT/EP94/00785

§ 371 Date: Oct. 30, 1995

§ 102(e) Date: Oct. 30, 1995

[87] PCT Pub. No.: WO94/25759

PCT Pub. Date: Nov. 10, 1994

[30] Foreign Application Priority Data

May 3, 1993 [DE] Germany ..... 43 14 419.5

[51] Int. Cl.[6] ..... F04D 29/66

[52] U.S. Cl. ..... 415/90; 415/229; 417/423.4

[58] Field of Search ..... 415/90, 229; 417/423.4

[56] References Cited

U.S. PATENT DOCUMENTS

| | | | |
|---|---|---|---|
| 1,677,464 | 7/1928 | Taylor | 415/229 |
| 3,416,723 | 12/1968 | Schmitz et al. | 415/229 |
| 3,969,039 | 7/1976 | Shoulders | 415/90 |
| 4,456,433 | 6/1984 | Henning et al. | 415/90 |
| 4,541,772 | 9/1985 | Becker | 415/90 |

FOREIGN PATENT DOCUMENTS

| | | | |
|---|---|---|---|
| 0408791 | 1/1991 | European Pat. Off. . | |
| 2086525 | 12/1971 | France . | |
| 2534980 | 4/1984 | France . | |
| 3531942 | 4/1986 | Germany . | |
| 3537822 | 4/1987 | Germany | 415/90 |
| 8910040 | 12/1989 | Germany . | |

OTHER PUBLICATIONS

Journal of Vacuum Science & Technology, No. 4, July 1988, Woodbury pps.2518–2521, "Developement of a new Type of Oil–Free Turbo vacuum pump", Mare et al.

*Primary Examiner*—Edward K. Look
*Assistant Examiner*—Mark Sgantzos
*Attorney, Agent, or Firm*—Harris Beach & Wilcox, LLP

[57] ABSTRACT

The invention relates to a friction vacuum pump (1) with a housing (2, 3), a rotor (8) and a rotor bearing (9) which is supported in the housing (2, 3) via a sleeve-like support (21). In order to obtain a precise support which nonetheless permits slight oscillations in the rotating system, it is proposed that the sleeve-like support (21) is in turn supported in the housing (2, 3) via several, preferably three, substantially axially extending rods (26).

12 Claims, 2 Drawing Sheets

FRICTION VACUUM PUMP WITH BEARING SUPPORT

BACKGROUND OF THE INVENTION

The invention relates to a friction vacuum pump, with a housing, a rotor and a rotor bearing which is supported in the housing via a sleeve-like support.

Gaede pumps (cylindrical rotor with a pumping slot and a barrier slot between inlet and outlet rotating in a housing), Holweck pumps (cylindrical rotor with spiral grooves on the stator or on the rotor rotating in a housing), Stegbahn pumps (rotating and fixed annular discs with spiral grooves) and turbomolecular pumps which are equipped with rotating and guiding blades, belong to the class of friction pumps. It is known to equip friction pumps with differently designed pumping sections.

The pumping characteristics of a friction pump depend chiefly on the distance between the active pumping surfaces which move relative to each other. The smaller the slot, the better in particular the compression of that friction pump will be. However, there are limits as to the minimum dimensions of the slot, since small oscillations of the rotor must be permitted. This applies particularly when passing through the range of resonance frequencies as the rotor runs up to its operating speed.

It is the task of the present invention to design, for a friction pump of the aforementioned kind, the support for the rotor bearing in the housing in such a way, that in spite of a support which permits oscillations of the rotating system, optimally small distances can be selected between the active pumping surfaces.

SUMMARY OF THE INVENTION

According to the present invention this task is solved by a sleeve-like support which supports the rotor bearing and which is in turn supported in the housing via several, preferably three, substantially axially extending rods. In a rotor which is suspended in this manner in a housing, oscillations which the rotor is still capable of, are constrained specifically in the radial direction. Motional components of the rotor in the axial direction are practically zero even in the case of relatively short rods. Radially extending slots between the active pumping surfaces can thus be made optimally small. Only in axially oriented slots the radial oscillations of the rotor will have to be taken into account.

To attenuate and reduce the radial oscillation amplitudes of the rotor it is expedient to provide an attenuation arrangement. This arrangement preferably consists of an O-ring which is located between the sleeve-like support and a housing section. This defines the maximum oscillation amplitude of the rotor. The slots extending in the axial direction must be selected in such a manner, that these will permit the slight maximally possible oscillations which may still occur.

BRIEF DESCRIPTION OF THE DRAWINGS

Further advantages and details of the present invention shall be explained on the basis of the design examples of the drawing figures.

Drawing

Drawing

Drawing

DESCRIPTION OF THE INVENTION

Figure 1:
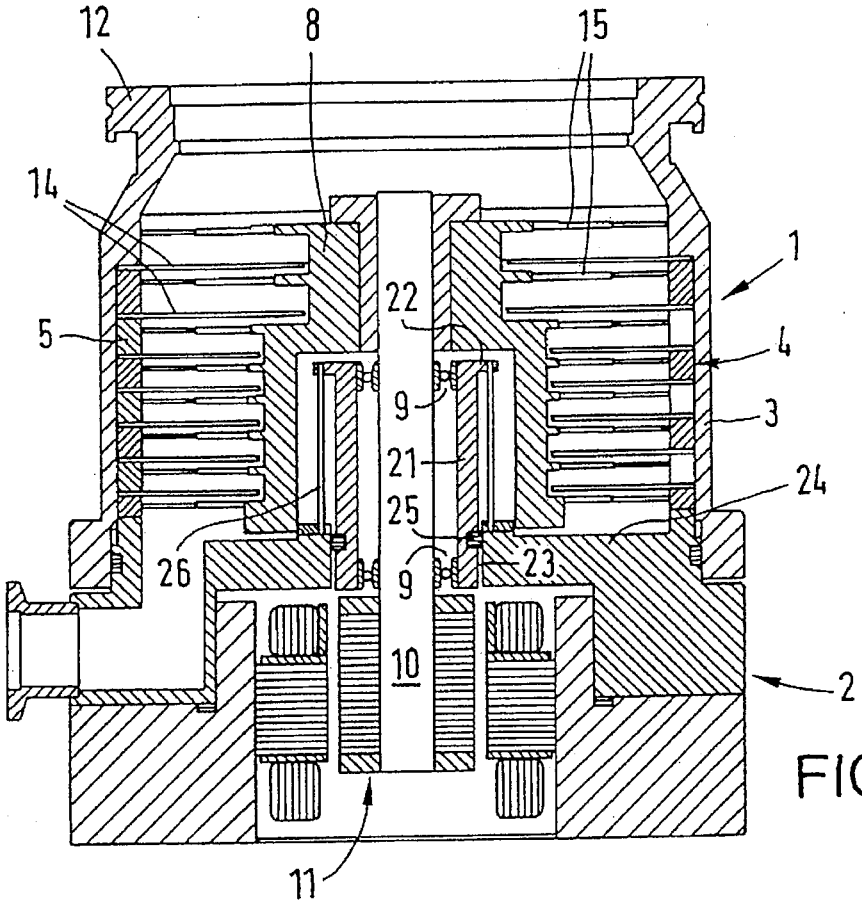
FIG. 1 shows a longitudinal section through a friction vacuum pump designed as a turbomolecular pump having a rotor suspension designed according to the present invention.

In the design examples, the different friction vacuum pumps are each generally marked as 1, their housing as 2 and the upper cylindrically designed housing section as 3. The cylindrical housing section 3 centers the stator 4 which comprises numerous stator rings 5, 6 and 7. The rotor 8 is supported by the bearings 9. In the design examples which are presented, the bearings 9 are designed as rolling bearings. Also magnetic bearings or sliding bearings may be used at these points. The drive motor is marked as 11. During operation of the pump, a vacuum chamber which is to be evacuated is connected to inlet flange 12. Due to the rotation of rotor 8, the gases are pumped to the outlet 13, to which a backing pump is connected.

The design example according to drawing FIG. 1 is a turbomolecular vacuum pump. The stator rings 5 each carry inside facing stator blades 14 to which rotor blades 15 attached to rotor 8 are related. The rotor 8 is supported via a shaft 10 by the rotor bearings 9.

The rotor support according to the present invention comprises sleeve-like support 21, the upper end of which is equipped with a collar 22. The lower end of the support 21 extends into a recess 23 of a housing component 24, the diameter of which is only slightly greater than the outside diameter of support 21. An O-ring 25 between the support 21 and the inside of recess 23 ensures on the one hand the central positioning of the support 21 and on the other hand it serves as an attenuating component.

In order to support the support 21 in housing 2, several, preferably three rods 26 which extend substantially in the axial direction are provided and which are attached at collar 22 and housing component 24. If a rotor 8 suspended in this manner oscillates due to impacts or when passing through resonances then these oscillations are constrained and practically only directed radially. In the event of occurring rotor oscillations, only a parallel displacement of the rotor in the radial direction will occur. Radially extending slots between the stator and rotor blades 14, 15 can be kept optimally small. In dimensioning the radially extending slots between the stator blades 14 and the rotor 8 on the one hand and the rotating blades 15 and the stator 4 on the other hand, only the slight radial oscillations must be taken into account. The amplitude of these oscillations depends on the dimensioning of the attenuation element 25.

The rods 26—preferably three—are best made of metal and have a stiffness over their length and the rod diameter which is matched to the dynamics of the machine. In the case of lengths of over 30 mm, axially directed oscillation components of the rotor 8 do practically not occur in view of the small radial deflections (<0.2 mm).

Figure 3:
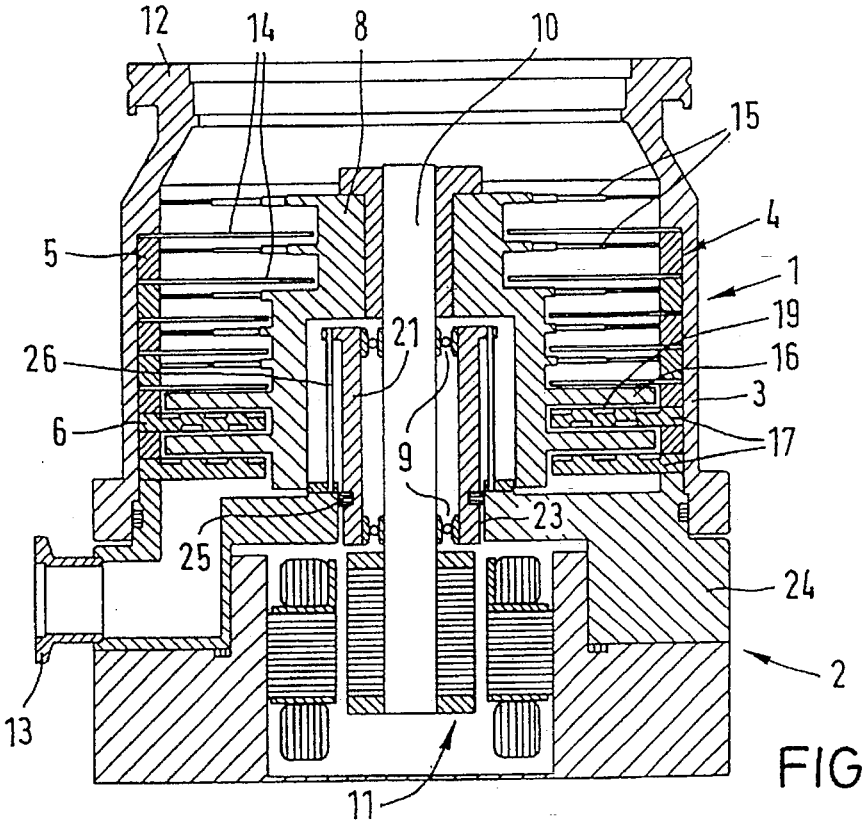
FIGS. 3 and 4 show further design examples for friction vacuum pumps having a rotor suspension according to the present invention.

In the design example according to drawing FIG. 3, two pumping sections are provided. Turbomolecular pumping stages 14, 15 are present on the high vacuum side followed by a Siegbahn pumping section. The individual Siegbahn pumping sections consist of annular rotor discs 16 and annular stator discs 17. The annular stator discs 17 rest on stator rings 6. On the face side they are equipped with spiral grooves 19. The design of the spiral in each case is such that a continual gas flow is ensured from the inlet 12 to the outlet 13, this means that in the design example which is shown, the active pumping surfaces of the Siegbahn stage above an annular stator disc 17, pump the gases from the outside to the inside and the active pumping surfaces below an annular stator disc 17 pump the gases from the inside to the outside. The axial slots between annular stator and rotor discs 16, 17 can be kept optimally small since the rotor 8 is practically incapable of oscillating axially. The pumping characteristics of the Siegbahn section, in particular its compression characteristics, are thus also optimal.

Figure 4:
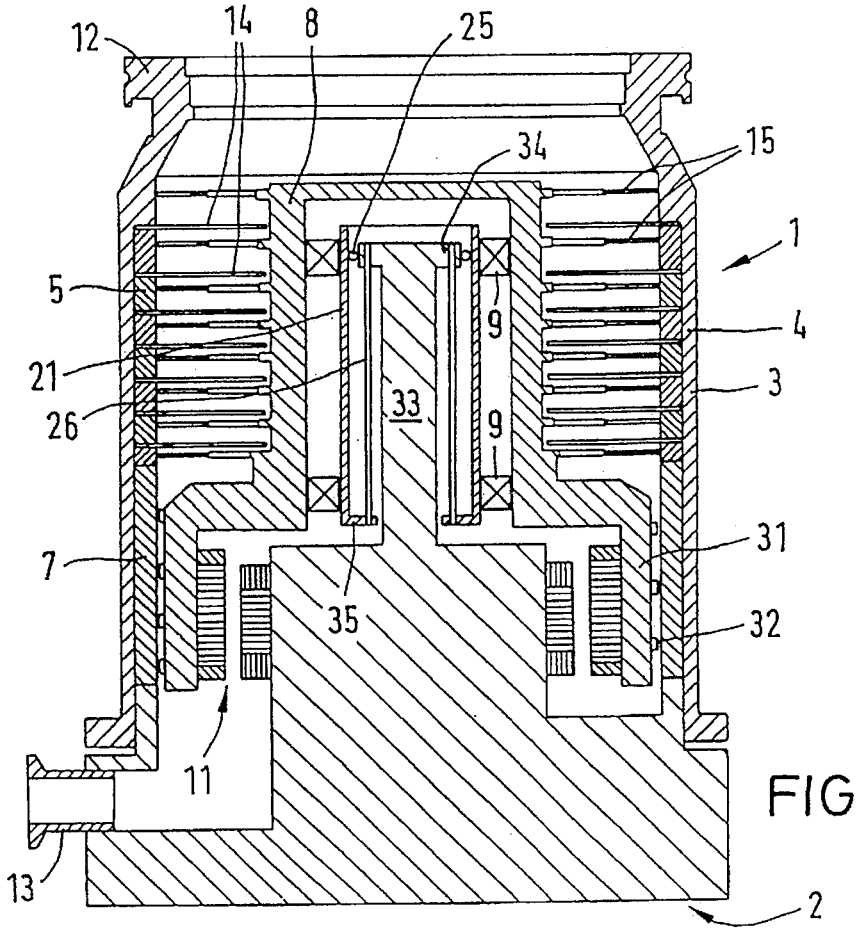

In the design example according to drawing FIG. 4, a Holweck pumping section follows after turbomolecular pumping section 14, 15. The Holweck pumping section comprises cylindrical stator ring 7, the inside of which is related to a cylindrical rotor section 31 with a spiral projection 32. In the dimensioning process for the axial slot between the active pumping surfaces only the very small radially directed amplitudes of the rotating system must be taken into account.

Figure 2:
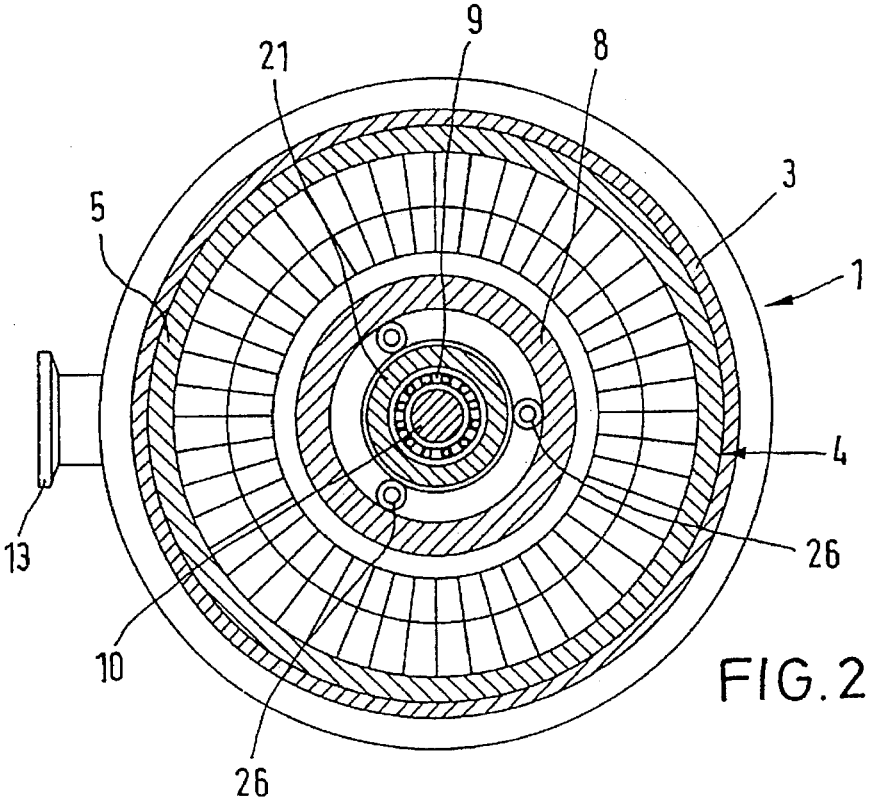
FIG. 2 shows a cross section through the design example according to drawing FIG. 1.

Moreover, the design example according to drawing FIG. 4 differs from the design examples according to drawing FIGS. 1 to 3, in that instead of a shaft 10 a journal 33 fixed to the housing is provided which supports rotor 8 via the bearings 9 and the sleeve-like support 21. The rods 26 extend between one collar 34 at the upper end of journal 33 and an inside facing rim 35 at the lower end of the sleeve-like support 21. The attenuation element 25 is located between the sleeve-like support 21 and the collar 34 of journal 33. In the case of a rotor support of this kind it is also required that the drive motor 11 be an external rotor motor.

What is claimed is:

1. Friction vacuum pump (1), comprising:

a housing (2,3);

a rotor (8);

two rotor bearings (9) which are supported in the housing (2,3) via a common sleeve-like support (21); and the sleeve-like support (21) is in turn supported in the housing (2,3) via at least three substantially axially extending rods (26), wherein a displacement of the rotor (8) is permitted only in a radial direction and axial movement of the rotor (8) is substantially limited.

2. Pump according to claim 1, wherein an attenuator (25) is connected to the sleeve-like support (21).

3. Pump according to claim 2, wherein the attenuator consists of an O-ring (25) which is arranged between the sleeve-like support (21) and a component (24, 34) fixed to the housing.

4. Pump according to claim 1, wherein the rotor (8) is equipped with a shaft (10), which is supported in the housing (2,3) via the two bearings (9), the sleeve-like support (21) and the at least three rods (26).

5. Pump according to claim 4, wherein the sleeve-like support (21) is equipped on one side with a collar (22) attached to the at least three rods (26).

6. Pump according to claim 1, wherein this pump is designed as a turbomolecular pump on a high vacuum side and as a Siegbahn pump on a forevacuum side.

7. Pump according to claim 1, wherein this pump is designed as a turbomolecular pump stage on a high vacuum side and as a Holweck pump on a forevacuum side.

8. A friction vacuum pump (1), comprising:

a housing (2,3);

a rotor (8);

a plurality of rotor bearings (9) which are supported in the housing (2,3) via a sleeve-like support (21), wherein the sleeve-like support (21) is in turn supported in the housing (2,3) via at least two substantially axially extending rods (26);

the rotor (8) being equipped with a shaft (10), which is supported in the housing (2,3) via the plurality of rotor bearings (9), the sleeve-like support (21) and the at least two rods (26);

the sleeve-like support (21) being equipped on one end with a collar (22) attached to the rods (26); and an attenuator (25) being related to a face side of the sleeve-like support (21) on an end of sleeve-like support (21) opposite to collar (22).

9. Pump according to claim 6, wherein the end of the sleeve-like support opposite to collar (22) extends into a recess (23) of a housing component (24) such that the attenuator (25) is an O-ring between the support (21) and the inside of the recess (23).

10. A friction vacuum pump (1), comprising:

a housing (2,3);

a rotor (8);

a plurality of rotor bearings (9) which are supported in the housing (2,3) via a sleeve-like support (21), wherein the sleeve-like support (21) is in turn supported in the housing (2,3) via at least two substantially axially extending rods (26); and the rotor (8) is supported, via its plurality of rotor bearings (9), the sleeve-like support (21) and the at least two rods (26), by a fixed journal (33) of the housing (2).

11. Pump according to claim 8, wherein:

the journal (33) is equipped with a collar (34);

the sleeve-like support is equipped on its side opposite collar (34) with an inside rim (35); and the plurality of rods (26) extend between collar (34) and inside rim (35).

12. Pump according to claim 11, wherein the sleeve-like support (21) embraces the collar (34) and an attenuator is located between collar (34) and the sleeve-like support (21).

* * * * *